US009012815B2

(12) United States Patent
Cha et al.

(10) Patent No.: US 9,012,815 B2
(45) Date of Patent: Apr. 21, 2015

(54) DRAWER UNIT FOR OVEN AND OVEN HAVING SAME

(75) Inventors: Jungmin Cha, Changwon (KR); Byoungwoo Choi, Changwon (KR); Seungjun Lee, Changwon (KR); Dongwan Lim, Changwon (KR)

(73) Assignee: LG Electronics Inc., Seoul (KR)

( * ) Notice: Subject to any disclaimer, the term of this patent is extended or adjusted under 35 U.S.C. 154(b) by 298 days.

(21) Appl. No.: 13/553,715

(22) Filed: Jul. 19, 2012

(65) Prior Publication Data

US 2013/0020308 A1 Jan. 24, 2013

(30) Foreign Application Priority Data

Jul. 21, 2011 (KR) ..... 10-2011-0072665

(51) Int. Cl.
*F24C 15/18* (2006.01)
*A47J 39/02* (2006.01)

(52) U.S. Cl.
CPC ..... *F24C 15/18* (2013.01)

(58) Field of Classification Search
CPC ..... F24C 15/18; A47J 39/00; A47J 39/006; H05B 3/06; H05B 3/0076; H05B 2203/32
See application file for complete search history.

(56) References Cited

U.S. PATENT DOCUMENTS

| | | | | |
|---|---|---|---|---|
| 2,472,293 | A * | 6/1949 | Groven | 34/60 |
| 2,897,337 | A * | 7/1959 | Schiff | 392/430 |
| 3,693,538 | A * | 9/1972 | Synder | 99/447 |
| 4,761,529 | A * | 8/1988 | Tsisios | 219/685 |
| 4,910,386 | A * | 3/1990 | Johnson | 219/385 |
| 5,196,674 | A * | 3/1993 | Chartrain et al. | 219/211 |
| 5,390,588 | A * | 2/1995 | Krasznai et al. | 99/389 |
| 5,471,914 | A * | 12/1995 | Krasznai et al. | 99/389 |
| 6,337,466 | B1 * | 1/2002 | Chasen | 219/405 |
| 6,348,676 | B2 * | 2/2002 | Kim et al. | 219/411 |
| 6,849,835 | B2 * | 2/2005 | Bollmers et al. | 219/520 |
| 6,917,016 | B2 * | 7/2005 | Backer et al. | 219/392 |
| 7,038,175 | B2 * | 5/2006 | Henninger et al. | 219/394 |
| 7,166,821 | B2 * | 1/2007 | Adamski | 219/400 |
| 7,279,659 | B2 * | 10/2007 | Gagas et al. | 219/400 |
| 7,312,423 | B2 * | 12/2007 | Idomoto et al. | 219/402 |
| 7,348,521 | B2 * | 3/2008 | Lee et al. | 219/402 |
| 7,420,140 | B2 * | 9/2008 | Lenhart et al. | 219/412 |
| 7,488,919 | B2 * | 2/2009 | Gagas et al. | 219/400 |
| 2004/0020915 | A1 * | 2/2004 | Shei | 219/385 |
| 2004/0129692 | A1 * | 7/2004 | Kim et al. | 219/400 |
| 2004/0149731 | A1 * | 8/2004 | Bollmers et al. | 219/520 |
| 2005/0274712 | A1 * | 12/2005 | Gagas et al. | 219/494 |
| 2006/0011606 | A1 * | 1/2006 | Henninger et al. | 219/394 |
| 2006/0278629 | A1 * | 12/2006 | Gagas et al. | 219/385 |
| 2009/0200901 | A1 * | 8/2009 | Suetsugu | 312/236 |
| 2014/0116267 | A1 * | 5/2014 | Hochschild et al. | 99/473 |

FOREIGN PATENT DOCUMENTS

| | | |
|---|---|---|
| JP | 2007-085646 | 4/2007 |
| KR | 10-2011-0078910 A | 7/2011 |

* cited by examiner

*Primary Examiner* — Joseph M Pelham
(74) *Attorney, Agent, or Firm* — Birch, Stewart, Kolasch & Birch, LLP

(57) ABSTRACT

A drawer unit for an oven is provided. The drawer unit includes a drawer casing, a drawer movable into and out from the drawer casing, the drawer defining an accommodation space configured to accommodate food or a food container, and a warming heater disposed at an upper portion of the drawer casing between the drawer casing and the drawer to provide warming energy to the accommodation space. In addition, an oven including the drawer unit is also provided.

20 Claims, 8 Drawing Sheets

DRAWER UNIT FOR OVEN AND OVEN HAVING SAME

CROSS-REFERENCE TO RELATED APPLICATIONS

This application is claims the benefit of priority to Korean Application No. 10-2011-0072665, filed on Jul. 21, 2011, which is herein incorporated by reference in its entirety.

BACKGROUND OF THE DISCLOSURE

1. Field of the Disclosure

The present disclosure relates generally to a drawer unit and an oven having the drawer unit. More particularly, the present disclosure relates to a drawer unit having a warming heater and an oven having the drawer unit.

2. Description of Related Art

Ovens are used to cook foods using heat generated by electricity or gas. In general, ovens include a drawer unit in which food or a food container is heated. Such a drawer unit includes a drawer, a drawer casing, and a heating source. Food or a food container is placed in the drawer which can be moved into and out from the drawer casing. The heating source is used to heat the food or the food container.

In the related art, the drawer casing is formed into a hexahedral shape having opened front and bottom sides. The heating source is disposed under the drawer casing to heat the drawer placed in the drawer casing. Therefore, when the drawer is detached from the drawer casing, the heating source is exposed to the outside. In addition, heat may not be efficiently transferred from the heating source to food or a food container placed in the drawer.

BRIEF SUMMARY OF THE DISCLOSURE

The exemplary embodiment provides a drawer unit having a heating source and an oven including the drawer unit. The heating source is configured to heat food or a food container and is not exposed to the outside of the oven. In addition, food or a food container can be heated more efficiently in the drawer unit.

According to the exemplary embodiment, a drawer unit for an oven is provided. The drawer unit includes a drawer casing, a drawer movable into and out from the drawer casing, the drawer defining an accommodation space configured to accommodate food or a food container, and a warming heater disposed at an upper portion of the drawer casing between the drawer casing and the drawer to provide warming energy to the accommodation space.

In addition, according to the exemplary embodiment, an oven is provided. The oven includes a cabinet, an oven unit located in the cabinet, and a drawer unit located under the oven unit in the cabinet. The drawer unit includes a drawer casing, a drawer movable into and out from the drawer casing, the drawer defining an accommodation space configured to accommodate food or a food container, and a warming heater disposed at an upper portion of the drawer casing between the drawer casing and the drawer to provide warming energy to the accommodation space.

The details of an exemplary embodiment of a drawer unit and an oven having the drawer unit are set forth in the accompanying drawings and the description below. Other features will be apparent from the description and drawings, and from the claims.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE DISCLOSURE

Hereinafter, an explanation will be given of an exemplary embodiment of a drawer unit and an oven having the drawer unit with reference to the accompanying drawings.

Figure 1:
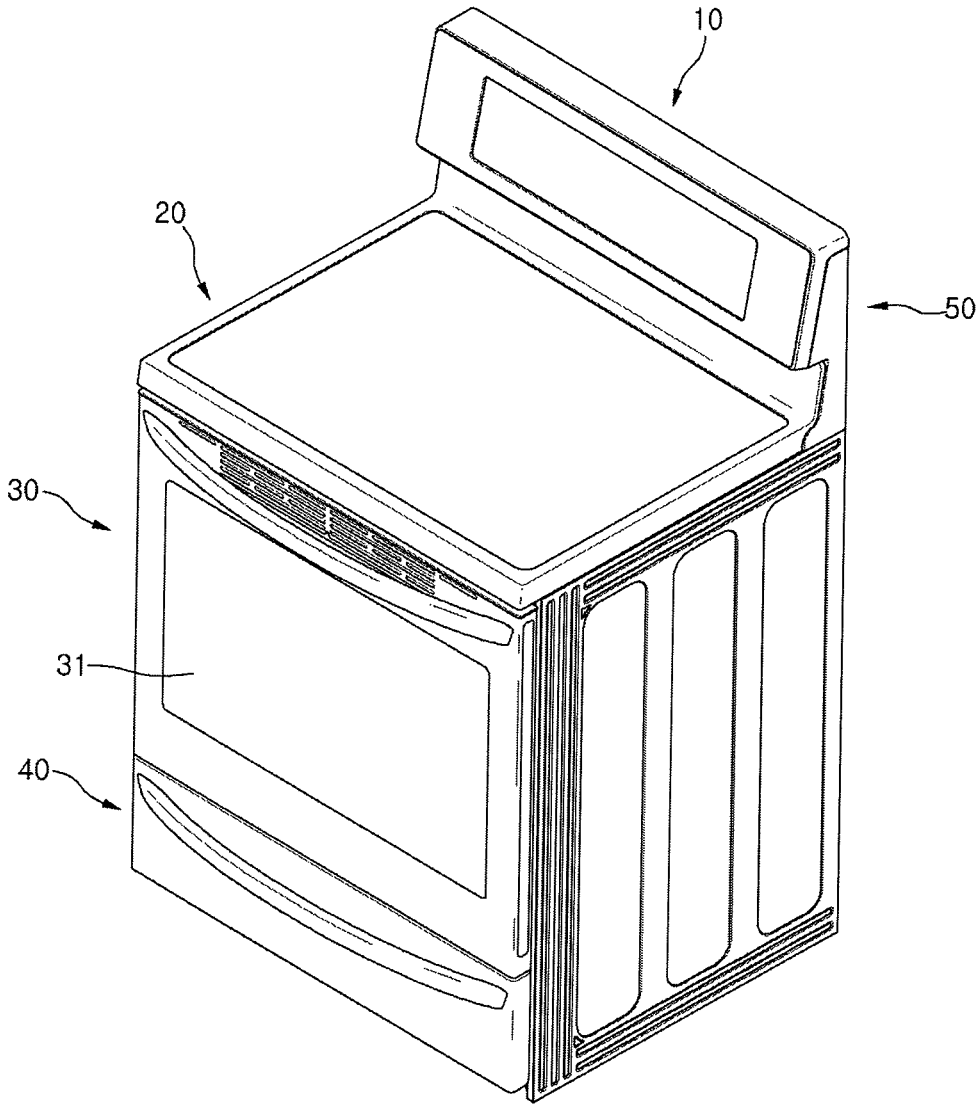
FIG. 1 is a perspective view illustrating an oven according to an exemplary embodiment.

Referring to FIG. 1, a cooktop 20 is provided on the topside of a cabinet 10 of the oven 1. A plurality of cooktop heaters (not shown) is disposed in the cooktop 20 for heating food. An oven unit 30 is disposed in the cabinet 10 under the cooktop 20. The oven unit 30 includes an oven chamber (not shown) in which food is cooked using a heating source. The oven unit 30 includes an oven door 31 so that the oven chamber can be selectively opened and closed.

Figure 2:
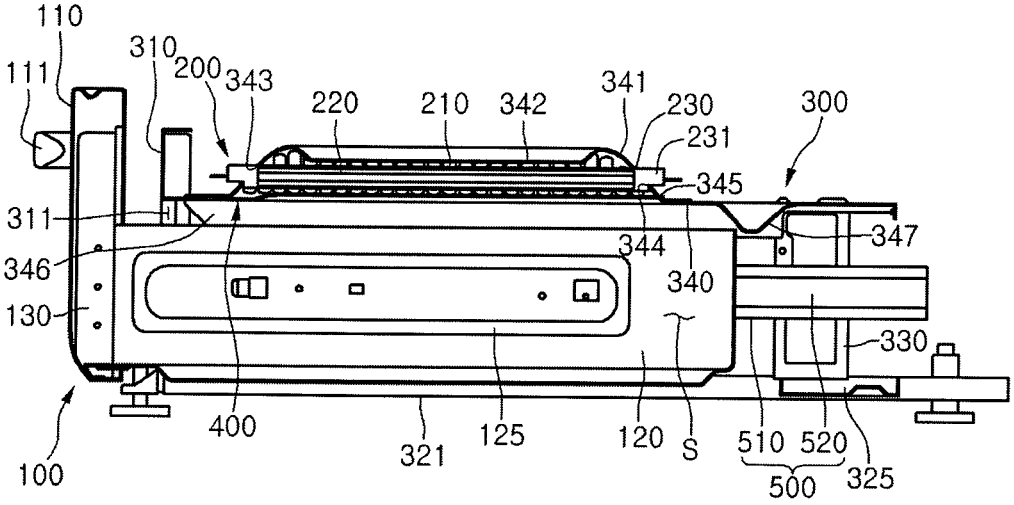
FIG. 2 is a vertical sectional view illustrating main parts of the oven according to the exemplary embodiment.
Figure 3:
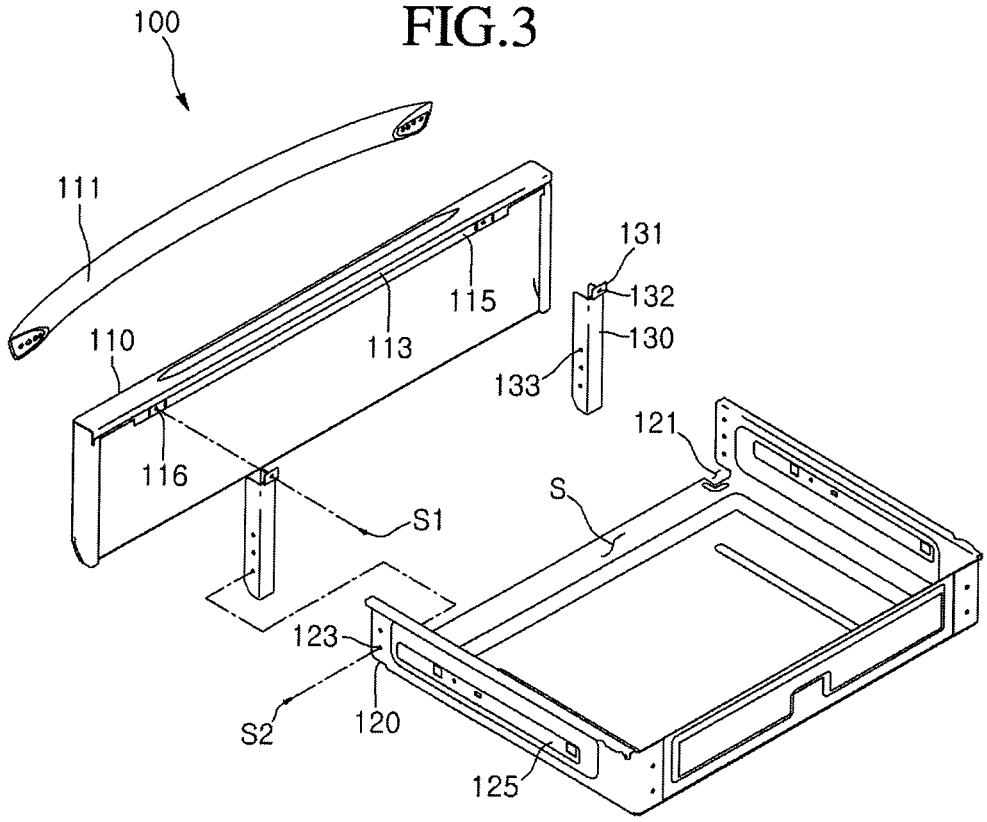
FIG. 3 is an exploded perspective view illustrating a drawer according to the exemplary embodiment.
Figure 4:
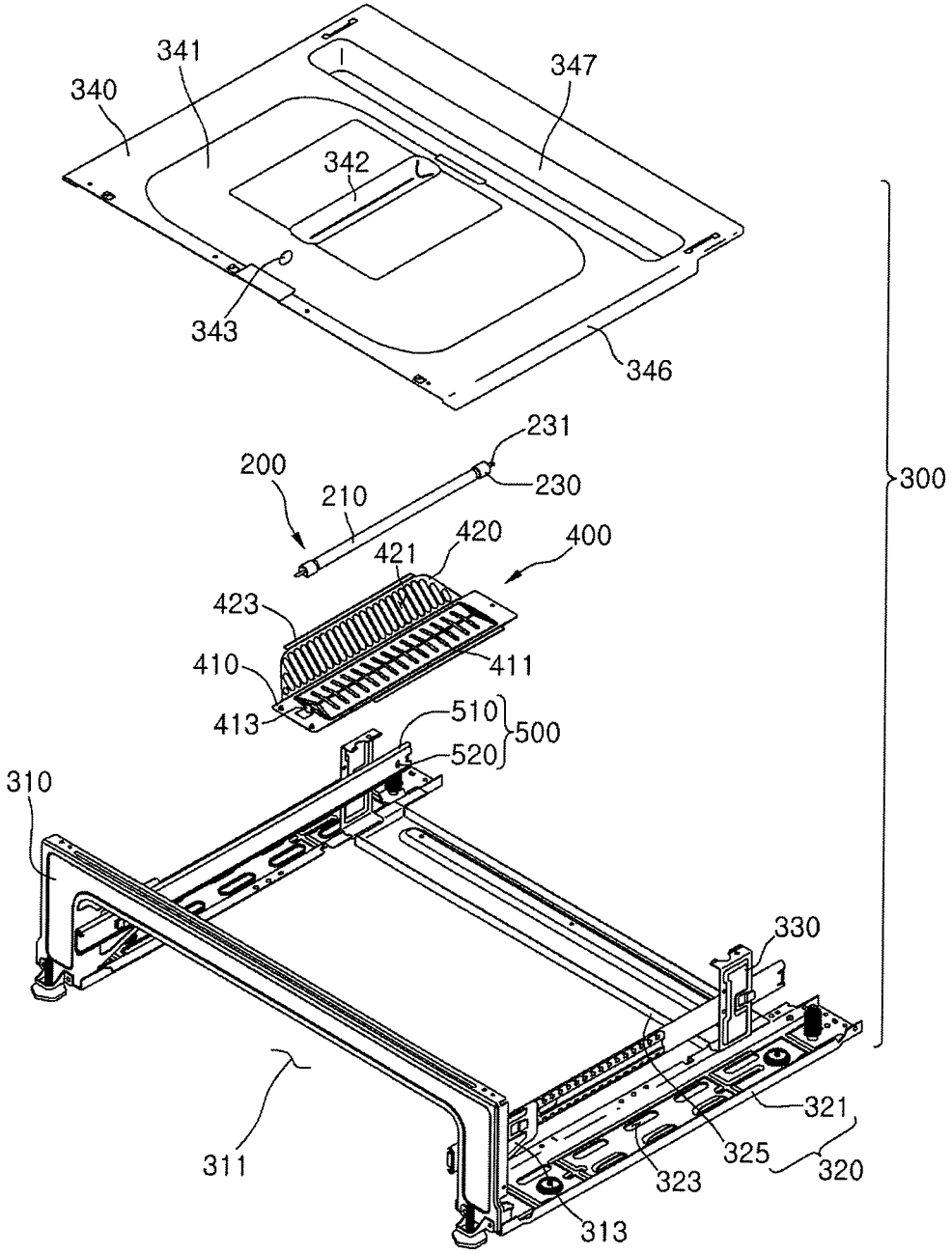
FIG. 4 is an exploded perspective view illustrating a drawer casing according to the exemplary embodiment.

A drawer unit 40 is disposed in a lower portion of the cabinet 10 under the oven unit 30. Food or a food container may be placed in the drawer unit 40 to be heated. Referring to FIGS. 2 to 4, the drawer unit 40 includes the drawer 100, a warming heater 200, a drawer casing 300, a grate 400, and a rail assembly 500. With this arrangement, a food container is placeable in the drawer 100, and the drawer 100 can be moved into and out from the cabinet 10.

A control panel 50 is disposed on the rear end of the topside of the cabinet 10. That is, the control panel 50 is disposed behind the cooktop 20. The control panel 50 receives signals for operating the cooktop 20, the oven unit 30, and the drawer unit 40. In addition, the control panel 50 displays information about operations of the cooktop 20, the oven unit 30, and the drawer unit 40.

The drawer 100 includes a front panel 110, a drawer body 120, and connection members 130. The front panel 110 forms the front side of the drawer 100. The front panel 110 has a flat hexahedral shape with an opened rear side. Therefore, the amount of a material necessary for fabricating the front panel 110 can be reduced. For example, the front panel 110 may be formed of the same material as that used for forming the oven door 31. In this case, the front side of the oven 1 may be uniform. When the drawer 100 is fully placed in the drawer casing 300, the front panel 110 may be spaced apart from the front side of the drawer casing 300 so that the front side of the front panel 110 may be flush with the front side of the oven door 31.

A drawer handle 111 is provided on the front side of the front panel 110. A user can push the drawer 100 into the cabinet 10 and pull the drawer 100 from the cabinet 10 by holding the drawer handle 111.

A reinforcement flange 113 (FIG. 3) is provided on the upper rear edge of the front panel 110. The reinforcement flange 113 extends horizontally from the upper rear edge of the front panel 110 to the inside of the front panel 110. The reinforcement flange 113 reinforces the top and lateral sides of the front panel 110.

A coupling flange 115 is provided on the lower end of the reinforcement flange 113 disposed on the upper edge of the front panel 110. Specifically, the coupling flange 115 extends downward from the lower end of the reinforcement flange 113 disposed on the upper edge of the front panel 110. First coupling holes 116 are formed in both lateral ends of the coupling flange 115, respectively. First fasteners S1 are coupled to the first coupling holes 116 for fixing the connection members 130 to the coupling flanges 115 of the front panel 110.

Coupling ribs 131 are provided on the upper ends of the connection members 130. The coupling ribs 131 extend upward from the upper ends of the connection members 130. The coupling ribs 131 are stepped back from the rear sides of the connection members 130 by a distance corresponding to the thickness of the coupling flange 115. If the front ends of the connection members 130 are brought into contact with the inner surface of the front side of the front panel 110, the coupling ribs 131 may also be in contact with the rear side of the coupling flange 115. First penetration holes 132 are formed in the coupling ribs 131, and the first fasteners S1 are coupled to the first coupling holes 116 through the first penetration holes 132 of the coupling ribs 131.

The drawer body 120 provides an accommodation space (S) in which a food container can be placed. The drawer body 120 has a hexahedral shape with opened front and top sides. Cut portions 121 are formed in the front ends of corners formed by the lateral and bottom sides of the drawer body 120. The lower ends of the connection members 130 are placed in the cut portions 121.

A plurality of second penetration holes 123 are formed in the front ends of the lateral sides of the drawer body 120. Second fasteners S2 are coupled to the second penetration holes 123 for fixing the connection members 130 to the drawer body 120. Specifically, second coupling holes 133 are formed in both lateral sides of the connection members 130. The second fasteners S2 are inserted through the second penetration holes 123 and the second coupling holes 133.

Rail fixing parts 125 are provided on both lateral sides of the drawer body 120. The rail fixing parts 125 may extend in a front-to-rear direction and may be formed by outwardly protruding portions of both lateral sides of the drawer body 120, for example, center portions of both lateral sides of the drawer body 120. Transfer rails 520 of the rail assembly 500 are fixed to the drawer body 120.

The connection members 130 are fixed to both the front panel 110 and the drawer body 120 to connect the front panel 110 and the drawer body 120 together. In the exemplary embodiment, the connection members 130 have a predetermined length, and the cross sections of the connection members 130 are shaped like ⊓ with an opened front side. When assembled, the front ends of the connection members 130 are in contact with an inner surface of the front side of the front panel 110. The lower ends of the connection members 130 are placed in the cut portions 121. The connection members 130 can be preliminarily fixed to the drawer body 120 by placing the lower ends of the connection members 130 in the cut portions 121.

The warming heater 200 provides energy such as light or light and heat so as to heat a food container placed in the accommodation space (S). In the exemplary embodiment, the warming heater 200 is disposed at an upper side of the drawer 100. That is, the warming heater 200 is disposed at the topside of the drawer body 120. Therefore, although the drawer 100 is completely pulled out of the drawer casing 300, the warming heater 200 is not exposed to the outside. The warming heater 200 is placed in a first recessed part 341, which will be described in greater detail below, and is fixed by the grate 400.

For example, the warming heater 200 may be a quartz tube heater. Referring to FIGS. 2 and 4, the warming heater 200 includes a quartz tube 210, a filament 220 disposed in the quartz tube 210, and sealing parts 230 hermetically closing both ends of the quartz tube 210. The sealing parts 230 have a cylindrical shape. The sealing parts 230 include stepped portions 231. For example, portions of the sealing parts 230 are cut off to form the stepped portions 231. As a result, the stepped portions 231 have an approximately semicircular sectional shape.

The drawer casing 300 is disposed in the cabinet 10. The drawer 100 can be moved into and out from the drawer casing 300. The drawer casing 300 includes a front member 310, base members 320, side members 330, and an upper member 340.

The front member 310 forms the front side of the drawer casing 300 and is exposed to the outside to form the front side of the cabinet 10 at the drawer unit 40. The topside of the front member 310 may be fixed to a member forming the front side of the oven unit 30. The front member 310 has a ⊓ shape with an opened bottom side. The front member 310 forms an inlet 311 through which the drawer 100 is moved into and out from the drawer casing 300. The inlet 311 has a predetermined size so that the front side of the inlet 311 can be completely blocked by the front panel 110.

When the drawer 100 is placed in the drawer casing 300, the front side of the front member 310 is spaced apart from the front panel 110. That is, when the drawer 100 is placed in the drawer casing 300, a gap is formed between the front panel 110 and front member 310. Hereinafter, the gap between the front panel 110 and the front member 310 will be referred to as an air outlet. The drawer body 120 is placed between the front panel 110 and the front member 310 whereby the upper side of the air outlet is opened. Air can be discharged from the inside of the drawer unit 40 through the air outlet (See FIG. 5).

Rail fixing brackets 313 are disposed at the front member 310. The rail fixing brackets 313 are used to hold fixed rails 510 of the rail assembly 500. The rail fixing brackets 313 extend backward from inner edges of the front member 310 close to the inlet 311.

The base member 320 forms portions of the bottom side of the drawer casing 300 and includes two first base members 321 and a second base member 325. The first base members 321 have a bar shape with a predetermined length. Front ends of the first base members 321 are fixed to the lower end of the front member 310. That is, the first base members 321 are fixed to the front member 310 and extend in parallel with each other. The first base members 321 are fixed to the cabinet 10.

Figure 5:
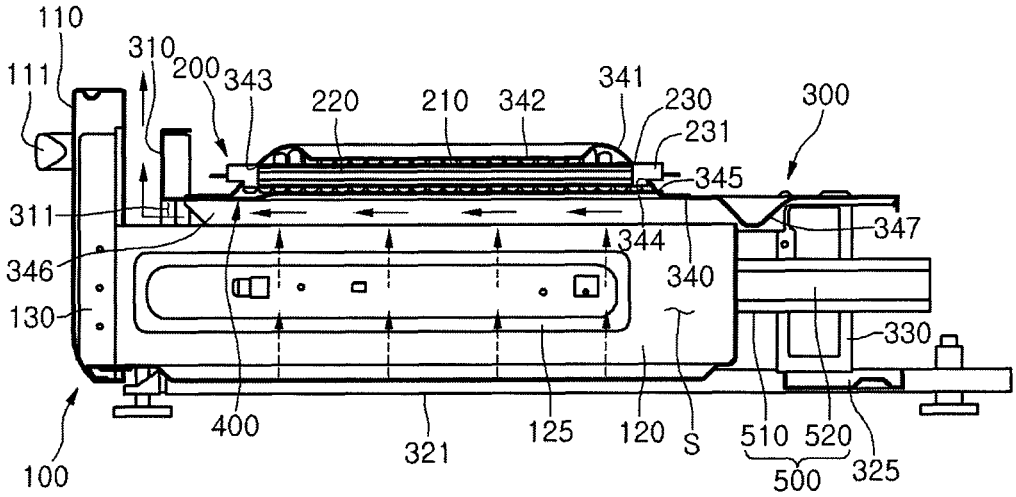
FIGS. 5 and 6 are schematic views illustrating how air flows through the drawer unit.
Figure 6:
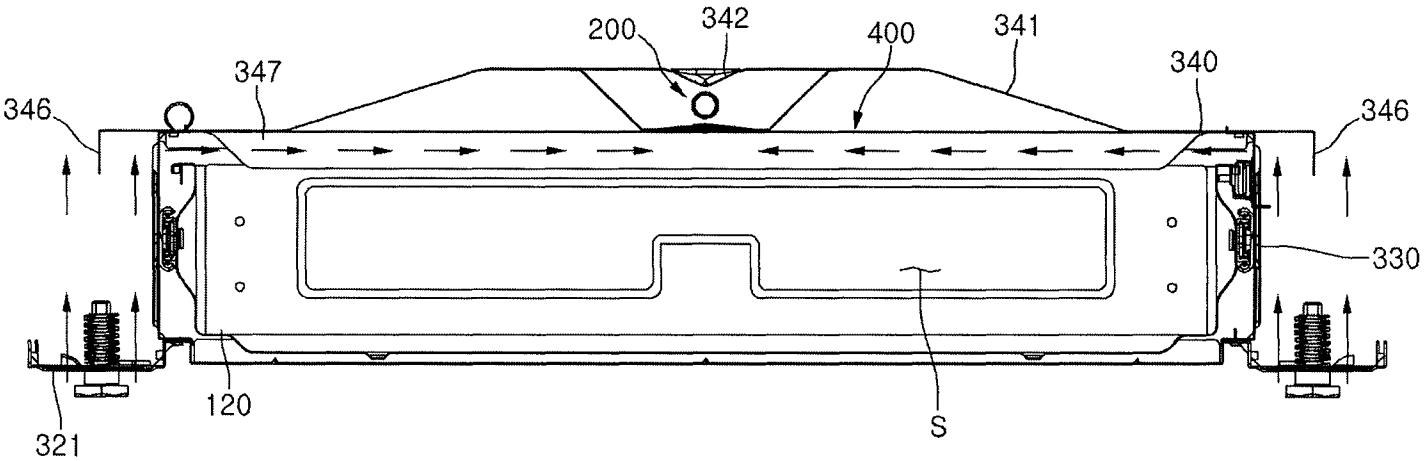

A plurality of suction holes 323 are formed in the first base members 321. As best seen in FIGS. 5 and 6, air is sucked into the cabinet 10 through the suction holes 323. Some of air sucked into the cabinet 10 through the suction holes 323 is transferred into the drawer unit 40. The rest of the air sucked into the cabinet 10 through the suction holes 323 is transferred to the oven unit 30 or other components disposed in the cabinet 10.

Referring to FIGS. 2 and 4, the second base member 325 is fixed to rear end parts of the first base members 321 so that the spacing of the first base members 321 is fixed relative to the front member 310.

The side members 330 are fixed to bottom sides of the base members 320. In the exemplary embodiment, the side members 330 extend upward from the first base members 321. The side members 330 are spaced apart from each other like the rail fixing brackets 313. The fixed rails 510 of the rail assembly 500 are fixed to the side members 330.

The upper member 340 has a plate shape with a predetermined size. The upper member 340 forms the topside of the drawer casing 300. The upper member 340 is fixed to an upper end part of the front member 310 and the upper ends of the side members 330. The warming heater 200 is fixed to the upper member 340.

More particularly, the upper member 340 includes first and second recessed parts 341 and 342. The first recessed part 341 is formed by upwardly protruding a portion of the upper member 340. The warming heater 200 is placed in the first recessed part 341. Therefore, when the drawer 100 is moved into or out from the drawer casing 300, the drawer 100 may not interfere with the warming heater 200. The second recessed part 342 is formed by downwardly recessing a portion of the first recessed part 341. The second recessed part 342 is positioned just above the warming heater 200 disposed in the first recessed part 341. The second recessed part 342 reinforces the first recessed part 341.

Heater insertion openings 343 and 344 are formed in the front and rear sides of the first recessed part 341. Both ends of the warming heater 200 are inserted in the heater insertion openings 343 and 344. In the following description, the heater insertion opening 343 is formed through the front side of the first recessed part 341 and will be referred to as a first heater insertion opening 343, and the other heater insertion opening will be referred to as a second heater insertion opening 344. In the exemplary embodiment, the size of the first heater insertion opening 343 is equal to or greater than the cross section of the quartz tube 210. The second heater insertion opening 344 is equal to or smaller than the sealing parts 230, but equal to or greater than the stepped portions 231. Therefore, the warming heater 200 can be taken out of the first recessed part 341 through the first heater insertion opening 343 from a state where one of the stepped portions 231 is inserted in the second heater insertion opening 344.

A grate insertion slot 345 (FIG. 2) is formed in the rear side of the first recessed part 341. A portion of the grate 400 is inserted in the grate insertion slot 345. The grate insertion slot 345 is formed by cutting off a portion of the rear side of the first recessed part 341. The grate insertion slot 345 is disposed under the second heater insertion opening 344.

The upper member 340 includes first and second heat shields 346 and 347. By providing the first and second heat shields 346 and 347, energy transferred from the warming heater 200 to the accommodation space (S) may not dissipate to the outside of the drawer 100, particularly, to the rear side of the drawer 100. The first heat shields 346 extend or are bent downward from both lateral ends of the upper member 340. The second heat shield 347 extends in a horizontal direction and extends downward from a rear end portion of the upper member 340. For example, the second heat shield 347 may be formed by downwardly recessing a rear end portion of the upper member 340.

The first and second heat shields 346 and 347 are spaced apart from the lateral and rear sides of the drawer body 120 when the drawer body 120 is placed in the drawer casing 300. That is, gaps are formed between the lateral sides of the drawer body 120 and the first heat shields 346, and a gap is formed between the rear side of the drawer body 120 and the second heat shield 347. In the following description, the gaps between the lateral sides of the drawer body 120 and the first heat shields 346, and the gap between the rear side of the drawer body 120 and the second heat shield 347 will be referred to as air inlets. The first and second heat shields 346 and 347 extend downward or are recessed downwardly such that the bottom sides of the air inlets are opened. Air is sucked into the drawer unit 40 through the air inlets (See FIG. 5). In addition, lower portions of the first and second heat shields 346 and 347 are overlapped with upper portions of the lateral and rear sides of the drawer 100 when the drawer 100 is placed in the drawer casing 300.

The grate 400 protects and fixes the warming heater 200. In addition, when food placed in the accommodation space (S) is heated, the grate 400 prevents the warming heater 200 from being contaminated by contaminants generated from the food. The grate 400 is fixed to the upper member 340 and disposed in the first recessed part 341. In the exemplary embodiment, the grate 400 includes a horizontal part 410 and two oblique parts 420 extending from both lateral ends of the horizontal part 410 at predetermined angles.

The horizontal part 410 has a plate shape with a predetermined length in a front-to-rear direction. The horizontal part 410 is disposed under the warming heater 200. The rear end of the horizontal part 410 is inserted in the grate insertion slot 345. The front end of the horizontal part 410 is located in front of the first recessed part 341 and makes contact with the bottom side of the upper member 340. In a state where the rear end of the horizontal part 410 is inserted in the grate insertion slot 345, the front end of the horizontal part 410 may be fixed to the upper member 340 by using fasteners. The height of the bottom surface of the horizontal part 410 is substantially equal to or higher than the bottom surface of the first recessed part 341.

A plurality of first communication openings 411 are formed through the horizontal part 410. Energy is transferred from the warming heater 200 to the accommodation space (S) through the first communication openings 411. Portions of the horizontal part 410 extending in a side-to-side direction may be cut off to provide the first communication openings 411. The first communication openings 411 are spaced apart from each other in a front-to-rear direction.

A heater support rib 413 is disposed on the horizontal part 410 so that the warming heater 200 is not freely detached from the inside of the first recessed part 341 through the first heater insertion opening 343. For this, in a state where one of the stepped portions 231 of the warming heater 200 is inserted in the second heater insertion opening 345, the heater support rib 413 holds the other of the stepped portions 231 close to the first heater insertion opening 343. The heater support rib 413 may be formed by cutting a portion of the horizontal part 410 and bending a surrounding region of the cut portion. That is, the heater support rib 413 is formed in one piece with the horizontal part 410.

A plurality of second communication openings 421 are formed through the oblique parts 420. The second communication openings 421 have the same function as the first communication openings 411. That is, energy is transferred from the warming heater 200 into the drawer 100 through the second communication openings 421.

Contact ribs 423 are provided on the upper ends of the oblique parts 420, respectively. The contact ribs 423 extend from the upper ends of the oblique parts 420 at predetermined angles and make contact with the bottom surface of the upper member 340.

In the exemplary embodiment, the second communication openings 421 are greater than the first communication openings 411 and are arranged more densely than the first communication openings 411. In other words, the ratio of the total area of the second communication openings 421 to the total area of the oblique parts 420 is greater than the ratio of the total area of the first communication openings 411 to the area of the horizontal part 410. As a result, while maintaining the total amount of energy from the warming heater 200 to the accommodation space (S) through the first and second communication openings 411 and 421, the strength of the horizontal part 410 close to food or a food container placed in the accommodation space (S) can be improved. In addition, contamination of the warming heater 200 through the horizontal part 410 can be efficiently prevented.

The rail assembly 500 guides the drawer 100 when the drawer 100 is moved into and out from the drawer casing 300. The rail assembly 500 includes the fixed rails 510 fixed to the drawer casing 300 and the transfer rails 520 fixed to the drawer 100. When the drawer 100 is moved into or out from the drawer casing 300, the transfer rails 520 slide on the fixed rails 510. The transfer rails 520 slide within a predetermined range of the fixed rails 510. Thus, although the drawer 100 is fully moved into the drawer casing 300, a predetermined gap between the front panel 110 and the front member 310 can be maintained.

Hereinafter, with reference to FIGS. 2 and 5-8, a detailed explanation will be given of how the drawer 100 of the oven 1 is used according to an embodiment.

If the warming heater 200 is operated in a state where the drawer 100 is placed in the drawer casing 300 as shown in FIG. 2, energy is transferred from the warming heater 200 to the accommodation space (S). Then, food or a food container placed in the accommodation space (S) is heated by the energy transferred from the warming heater 200. At this time, because of the first and second heat shields 346 and 347, the energy transferred to the accommodation space (S) from the warming heater 200 is prevented from being dissipated to the outside.

Energy is transferred from the warming heater 200 to the accommodation space (S) through the first and second communication openings 411 and 421 of the grate 400. As noted above, the second communication openings 421 are greater than the first communication openings 411 and are arranged more densely than the first communication openings 411. Therefore, while maintaining the total amount of energy from the warming heater 200 to the accommodation space (S) through the first and second communication openings 411 and 421, contamination and damage of the warming heater 200 can be efficiently prevented.

As shown in FIGS. 2, 5, and 6, the air inlets formed between the lateral sides of the drawer body 120 and the first heat shields 346 are open downward, and the air inlet between the rear side of the drawer body 120 and the second heat shield 347 is opened downward. In addition, the air outlet between the front panel 110 and the front member 310 is opened upward. In this state, the inside of the drawer unit 40 is heated to a relatively high temperature by the warming heater 200. Therefore, air can be sucked into the drawer unit 40 through the air inlets and then discharged through the air outlet from the inside of the drawer unit 40 after flowing throughout the inside of the drawer unit 40. Particularly, when food is heated in the accommodation space (S), air containing moisture or fat generated from food can be discharged from the inside of the drawer unit 40.

Figure 7:
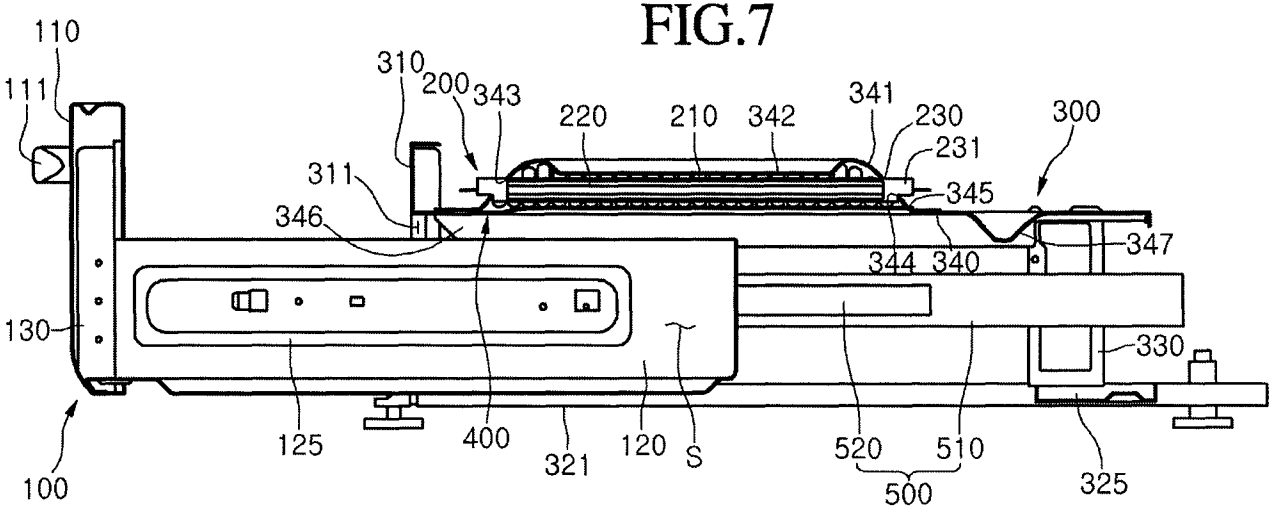
FIGS. 7 and 8 are vertical sectional views for explaining how the drawer of the oven is moved according to the exemplary embodiment.
Figure 8:
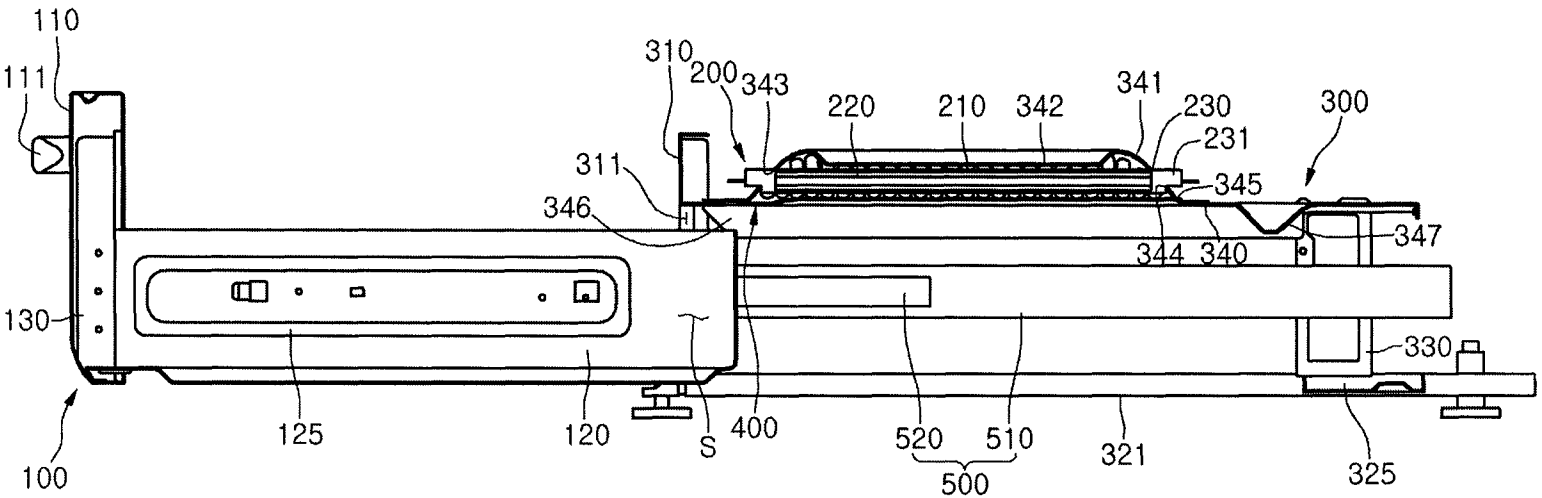

Next, as shown in FIGS. 7 and 8, a user can pull the drawer 100 by holding the handle 111 to take food or a food container from the accommodation space (S). Then, the transfer rails 520 slide on the fixed rails 510, and the drawer 100 is moved out from the drawer casing 300. Because the warming heater 200 is disposed in the first recessed part 341, when the drawer 100 is moved out from the drawer casing 300, the warming heater 200 may not be contaminated or damaged by the food or the food container.

According to the exemplary embodiment, components of the drawer unit of the oven can be reduced, and thus the drawer unit can be simplified.

In addition, according to the exemplary embodiment, food or a food container placed in the drawer unit can be heated more efficiently by using the warming heater disposed at an upper portion of the drawer unit.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

For example, while the second heat shield is described as being formed by downwardly recessing a portion of the upper member, the second heat shield may be formed by downwardly bending a portion of the upper member.

What is claimed is:

1. A drawer unit for an oven, the drawer unit comprising:

a drawer casing;

a drawer movable into and out from the drawer casing, the drawer defining an accommodation space configured to accommodate food or a food container; and a warming heater disposed at an upper portion of the drawer casing between the drawer casing and the drawer to provide warming energy to the accommodation space, wherein the drawer casing includes an upper member forming a top side of the drawer casing and having two lateral ends, the upper member including first heat shields extending downwardly from both lateral ends of the upper member, wherein when the drawer is placed in the drawer casing, the first heat shields are spaced apart from lateral sides of the drawer and lower portions of the first heat shields are overlapped with upper portions of the lateral sides of the drawer, wherein the drawer casing includes a front member forming a front side of the drawer casing, the front member defining an inlet through which the drawer is movable into and out from the drawer casing, and wherein air flows into the drawer unit through gaps between the lateral sides of the drawer and the first heat shields and is discharged from the drawer unit through a gap between a front side of the drawer and the front side of the drawer casing.

2. The drawer unit according to claim 1, wherein the drawer casing includes an upper member forming a top side of the drawer casing, the upper member including a first part formed by upwardly protruding a portion of the upper member.

3. The drawer unit according to claim 2, wherein the upper member further includes a second part formed by downwardly recessing a portion of the first recessed part, the second part being located adjacent the warming heater.

4. The drawer unit according to claim 1, wherein the upper member includes a second heat shield extending downward from a rear end of the upper member, and wherein, when the drawer is placed in the drawer casing, the second heat shield is spaced apart from a rear side of the drawer in a front-to-rear direction, and a lower portion of the second heat shield is overlapped with an upper portion of the rear side of the drawer.

5. The drawer unit according to claim 4, wherein the drawer casing further includes a front member forming a front side of the drawer casing, the front member defining an inlet through which the drawer is movable into and out from the drawer casing, and wherein air flows into the drawer unit through a gap between the rear side of the drawer and the second heat shield.

6. The drawer unit according to claim 1, further comprising a grate disposed between the heater and the drawer, the grate including a horizontal part having two lateral ends disposed under the warming heater and two oblique parts extending from both lateral ends of the horizontal part at predetermined angles, the two oblique parts contacting a bottom surface of the upper member.

7. The drawer unit according to claim 6, wherein the horizontal part includes a plurality of first communication openings to transfer energy from the warming heater to the accommodation space, wherein each of the oblique parts includes a plurality of second communication openings to transfer energy from the warming heater to the accommodation space, and wherein the second communication openings are greater in size than the first communication openings and are arranged more densely than the first communication openings.

8. The drawer unit according to claim 6, wherein the horizontal part includes a plurality of first communication openings to transfer energy from the warming heater to the accommodation space, wherein each of the oblique parts includes a plurality of second communication openings to transfer energy from the warming heater to the accommodation space, and wherein a ratio of a total area of the second communication openings to a total area of the oblique parts is greater than a ratio of a total area of the first communication openings to an area of the horizontal part.

9. The drawer unit according to claim 1, wherein the drawer unit includes a front side, a first lateral side, a second lateral side, and a rear side, the drawer unit including:

an air inlet provided at at least one of the first lateral side, the second lateral side, and the rear side of the drawer unit to allow air to flow into the drawer unit, and an air outlet is provided at the front side of the drawer unit to discharge air from the drawer unit.

10. The drawer unit according to claim 9, wherein air flowed into the drawer unit through the air inlet is directed upward, and air discharged from the drawer unit through the air outlet is directed upward.

11. The drawer unit according to claim 9, wherein the drawer casing further includes:

a base member forming a portion of a bottom side of the drawer casing, and wherein the warming heater is disposed at the upper member.

12. The drawer unit according to claim 11, wherein the drawer includes:

a front panel forming a front side of the drawer, the front panel being spaced apart from the front member in a forward direction when the drawer is placed in the drawer casing; and a drawer body fixed to a rear surface of the front panel and forming an accommodation space to accommodate food or a food container, wherein at least one air inlet includes air inlets formed between lateral and rear ends of the upper member and lateral and rear sides of the drawer body, and wherein the air outlet is formed between the front member and the front panel.

13. The drawer unit according to claim 12, wherein a second heat shield extends downward from the rear end of the upper member, and wherein the at least one air inlet includes air inlets formed between the first heat shields and the lateral sides of the drawer body and between the second heat shield and the rear side of the drawer body.

14. The drawer unit according to claim 9, wherein the drawer unit further comprises a grate disposed between the warming heater and the drawer, the grate being configured to support the warming heater.

15. The drawer unit according to claim 6, wherein the upper member includes a pair of heater insertion openings, wherein opposing ends of the warming heater are inserted through the heater insertion openings formed in the upper member, and wherein the grate prevents the warming heater from being detached from the upper member through one of the heater insertion openings.

16. An oven comprising:

a cabinet;

an oven unit located in the cabinet; and a drawer unit located under the oven unit in the cabinet, the drawer unit including:

a drawer casing;

a drawer movable into and out from the drawer casing, the drawer defining an accommodation space configured to accommodate food or a food container; and a warming heater disposed at an upper portion of the drawer casing between the drawer casing and the drawer to provide warming energy to the accommodation space, wherein the drawer casing includes an upper member forming a top side of the drawer casing and having two lateral ends, the upper member including first heat shields extending downwardly from both lateral ends of the upper member, wherein when the drawer is placed in the drawer casing, the first heat shields are spaced apart from lateral sides of the drawer and lower portions of the first heat shields are overlapped with upper portions of the lateral sides of the drawer, wherein the drawer casing includes a front member forming a front side of the drawer casing, the front member defining an inlet through which the drawer is movable into and out from the drawer casing, and wherein air flows into the drawer unit through gaps between the lateral sides of the drawer and the first heat shields and is discharged from the drawer unit through a gap between a front side of the drawer and the front side of the drawer casing.

17. The oven according to claim 16, wherein the drawer unit includes a front side, a first lateral side, a second lateral side, and a rear side, the drawer unit including:

an air inlet provided at at least one of the first lateral side, the second lateral side, and the rear side of the drawer unit to allow air to flow into the drawer unit, and an air outlet is provided at the front side of the drawer unit to discharge air from the drawer unit.

18. The oven according to claim 17, wherein the drawer casing includes:

a base member forming a portion of a bottom side of the drawer casing, and wherein the warming heater is disposed at the upper member.

19. The oven according to claim 18, wherein the drawer includes:

a front panel forming a front side of the drawer, the front panel being spaced apart from the front member in a forward direction when the drawer is placed in the drawer casing; and a drawer body fixed to a rear surface of the front panel and forming an accommodation space to accommodate food or a food container, wherein at least one air inlet includes air inlets formed between lateral and rear ends of the upper member and lateral and rear sides of the drawer body, and the air outlet is formed between the front member and the front panel.

20. The drawer unit according to claim 16, wherein the drawer unit further comprises a grate disposed between the warming heater and the drawer, the grate being configured to support the warming heater.

* * * * *